US010086384B2

(12) United States Patent
Thorwid et al.

(10) Patent No.: US 10,086,384 B2
(45) Date of Patent: Oct. 2, 2018

(54) CENTRIFUGAL SEPARATOR AND METHOD OF CONTROLLING INTERMITTENT DISCHARGE BY MONITORING FLOW THROUGH THE SEPARATOR

(71) Applicant: ALFA LAVAL CORPORATE AB, Lund (SE)

(72) Inventors: Peter Thorwid, Sundbyberg (SE); Roland Isaksson, Grödinge (SE); Hans Moberg, Stockholm (SE); Carl Häggmark, Täby (SE); Göran Krook, Stockholm (SE)

(73) Assignee: ALFA LAVAL CORPORATE AB, Lund (SE)

( * ) Notice: Subject to any disclaimer, the term of this patent is extended or adjusted under 35 U.S.C. 154(b) by 372 days.

(21) Appl. No.: 14/387,191

(22) PCT Filed: Mar. 22, 2013

(86) PCT No.: PCT/EP2013/056036
§ 371 (c)(1),
(2) Date: Sep. 22, 2014

(87) PCT Pub. No.: WO2013/143999
PCT Pub. Date: Oct. 3, 2013

(65) Prior Publication Data

US 2015/0045199 A1 Feb. 12, 2015

(30) Foreign Application Priority Data

Mar. 27, 2012 (EP) ..... 12161412

(51) Int. Cl.
*B04B 11/04* (2006.01)
*B04B 1/08* (2006.01)
(Continued)

(52) U.S. Cl.
CPC ..... *B04B 11/04* (2013.01); *B04B 1/08* (2013.01); *B04B 1/14* (2013.01); *B04B 13/00* (2013.01)

(58) Field of Classification Search
CPC .. B04B 1/08; B04B 1/14; B04B 13/00; B04B 11/04
(Continued)

(56) References Cited

U.S. PATENT DOCUMENTS 3,301,476 A * 1/1967 Hemfort, Jr. ..... B04B 1/14 494/3
3,408,000 A * 10/1968 Nilson ..... B04B 1/14 494/10
(Continued)

FOREIGN PATENT DOCUMENTS

CN 1154079 A 7/1997
CN 101384371 A 3/2009
(Continued)

*Primary Examiner* — Walter D. Griffin
*Assistant Examiner* — Shuyi S. Liu
(74) *Attorney, Agent, or Firm* — Birch, Stewart, Kolasch & Birch, LLP

(57) ABSTRACT

The invention relates to a centrifugal separator having a separation space with a set of separation plates, an inlet configured to feed a fluid product to be separated into the separation space, the inlet and the separation space being connected in a pressure mediating manner, a first and a second outlet extending from the separation space for discharge of a two phases of the product. A discharge control system is configured to trigger the opening of the second outlet upon a trigger condition, wherein the discharge control system comprises a sensor arranged to determine the inlet pressure and/or the inlet flow of fluid product, and the trigger condtion is associated with a decrease in inlet flow in relation to inlet pressure, indicating an increasing flow resistance downstream of the inlet. The invention further
(Continued)

relates to a discharge control system and a method of controlling the intermittent discharge of a centrifugal separator.

18 Claims, 3 Drawing Sheets

(51) Int. Cl.
*B04B 1/14* (2006.01)
*B04B 13/00* (2006.01)

(58) Field of Classification Search
USPC ..... 494/2, 37
See application file for complete search history.

(56) References Cited

U.S. PATENT DOCUMENTS 3,410,479 A 11/1968 Nilson
3,448,919 A 6/1969 Hemfort et al.
3,494,545 A 2/1970 Nilson
3,563,453 A 2/1971 Kompert et al.
3,580,493 A 5/1971 Jonsson
3,637,134 A 1/1972 Nelson
3,642,196 A * 2/1972 Nilsson ..... B04B 1/18 210/371
4,069,969 A 1/1978 Tanaka
4,820,256 A * 4/1989 Nordstrom ..... B04B 1/14 494/27
5,800,330 A 9/1998 Modéer
6,358,193 B1 * 3/2002 Nyberg ..... B03D 1/1418 494/10
6,821,241 B2 * 11/2004 Herman ..... B04B 1/08 494/49
7,485,084 B2 * 2/2009 Borgstrom ..... B04B 1/08 494/10
7,678,039 B2 3/2010 Åström
2005/0054505 A1 3/2005 Maehans

FOREIGN PATENT DOCUMENTS

EP 0225707 A1 * 6/1987 ..... B04B 1/08
EP 0225707 B1 10/1989
EP 1019196 A1 7/2000
EP 2799146 A1 * 11/2014 ..... B04B 1/20
GB 1099256 A 1/1968
GB 1099618 A 1/1968
GB 1199879 A 7/1970
JP 7-246349 A 9/1995
RU 68924 U1 12/2007
WO WO 99/16550 A1 4/1999
WO WO 2007/094715 A1 8/2007
WO WO 2009/010630 A1 1/2009

* cited by examiner

CENTRIFUGAL SEPARATOR AND METHOD OF CONTROLLING INTERMITTENT DISCHARGE BY MONITORING FLOW THROUGH THE SEPARATOR

TECHNICAL FIELD

The invention relates to a centrifugal separator for separation of a fluid product, comprising a discharge control system for controlling the intermittent discharge of a separated phase of the fluid product, and to a method of controlling the intermittent discharge of a centrifugal separator.

In particular the invention relates to a centrifugal separator according to the preamble of claim 1, to a discharge control system for such a centrifugal separator and to a method for controlling the intermittent discharge of such a centrifugal separator.

BACKGROUND ART

During operation of an intermittently discharging centrifugal separator, sludge collected in the radially outer portion of the separation space needs to be discharged in order to maintain a good separation efficiency. On the other hand, discharge is a disturbance in the process of separation and thus it may be sought to have a low frequency of discharge. By indicating the level of sludge in the separation space and to initiate discharge when the sludge reaches a certain level the discharge timing can be optimised.

Several techniques for indicating the level of sludge in a centrifugal separator are previously known wherein the level of sludge in the separation space is indicated by means of indicating channels extending from the separating space towards centre of the rotor. The indicating channels are adapted for passage of an indicating liquid through its radially outer end which is positioned to be blocked by sludge collected to a predetermined level in the separating space.

GB 1099256 A describes a centrifugal separator rotor provided with two indicating channels extending from two different radial distances from the rotor axis, whereby the level of sludge may be indicated by monitoring the difference in pressure, flow or turbidity in the two indicating channels.

U.S. Pat. No. 3,642,196 A describes another a centrifugal rotor with one indicating channel and an arrangement which provides a measurement of the difference between the pressure in the indicating channel and the pressure of the separated liquid.

A drawback with these solutions is that the rotor has to be provided with an extra feature, i.e. at least one indicating channel, whereby retrofitting is more difficult to obtain.

SUMMARY

It is an object of the invention to provide a centrifugal separator wherein the level of sludge in the separation space can be indicated by simple means which may be fitted to a centrifugal separator. It is also an object to improve the indication of the sludge level such that sludge is discharged from the separation space in a timely manner in order to obtain good separation performance of the phases of a separated fluid product and at the same time with a minimum of separation process disturbances due to the downtime during discharge.

Hence a centrifugal separator is provided, comprising a frame, a rotor arranged for rotation in the frame around a rotational axis and forming within itself a separation space. In the separation space a set of separation plates is arranged, extending from a radially outer portion of the separation space to a radially inner portion of the separation space. The set of separation plates may be a stack of frustoconical discs, distributed along the rotational axis. The centrifugal separator comprises an inlet configured to feed a fluid product (a liquid mixture of components) to be separated into the separation space. The centrifugal separator is configured such that the separation space is connected to the inlet in a pressure mediating manner during normal operation of the separator, such as in a pressure communicating manner. Pressure mediating manner means that the pressure in the inlet must be related to the pressure in the separation space such that a pressure change in the separation space results in a pressure change in the inlet during normal operation of the separator. By normal operation it is meant during the process of separating a fluid product at normal operating conditions, such as at rotational speed of the rotor and with production levels of fluid in the rotor. The separator further comprises a first outlet extending from the radially inner portion of the separation space for discharge of a first phase of the product having a lower density (a first component of the mixture), and a second outlet extending from the radially outer portion of the separation space for intermittent discharge of a second phase of the product having a higher density (a second component of the mixture). The second phase of the product is often referred to as the sludge phase since it may comprise particles, but it may also be a liquid phase essentially without particles whereby the first and second phases are immiscible liquid phases such as oil and water. The second outlet may be in the form of a plurality of discharge ports which are opened by means of an operating slide. The separator further comprises a discharge control system configured to trigger the opening of the second outlet upon a trigger condition. The discharge control system comprises a sensor arranged to determine the inlet pressure and/or the inlet flow of fluid product, and the trigger condition is associated with a decrease in inlet flow in relation to inlet pressure, indicating an increasing flow resistance downstream of the inlet. Equivalently, the trigger condition may be associated with an increase in the inlet pressure in relation to the inlet flow of fluid product.

Thereby the level of the second phase in the separation space, and thus the timing of discharge of the second phase, can be indicated by simple monitoring means positioned outside the rotor, which means may be retrofitted to a centrifugal separator without having to dismantle the rotor.

If the centrifugal separator is connected to a system wherein the inlet flow of fluid product at the separator inlet is controlled to have a constant pressure, an inlet pressure sensor is not necessary for the discharge control system to indicate an increasing flow resistance downstream of the inlet. The trigger condition is thereby associated with a decrease in inlet flow in relation to the constant inlet pressure. Alternatively, if the inlet flow of fluid product is controlled to have a constant flow, an inlet flow sensor is not necessary for the discharge control system to indicate an increasing flow resistance downstream of the inlet. Thereby the trigger condition is associated with an increase in the inlet pressure in relation to the constant inlet flow of fluid product. If the inlet flow of fluid product is predetermined but not constant, information on the amount of inlet flow may be input to the discharge control system from a device controlling the flow, such as an inlet pump, and also in this case an inlet flow sensor is not necessary for the discharge control system to indicate an increasing flow resistance downstream of the inlet.

The discharge control system may comprise an outlet pressure sensor arranged to determine the pressure in the first outlet, wherein the inlet pressure is compensated for the outlet pressure so as to represent a pressure drop. The trigger condition is thus associated with an increase in the pressure drop over the centrifugal separator in relation to the flow of fluid product and less dependent or independent on any components, such as various types of outlets, or disturbances downstream of the separation space. As one embodiment the centrifugal separator comprises a pump device connected to the first outlet, wherein the pressure drop is compensated for the pressure contribution of the pump device to the outlet pressure.

The inlet may be an hermetic inlet. A hermetic inlet is sealed from the surroundings of the rotor and is arranged to be filled with fluid product during operation. Thereby the inlet and the separation space are connected in a pressure communicating manner. The first outlet may further be an hermetic outlet. A hermetic outlet is sealed from the surroundings of the rotor and is arranged to be filled with fluid product during operation.

The inlet may comprise an inlet tube configured to be immersed in fluid product fed into the rotor during normal operation. By immersed, it is meant that at least part of the inlet tube comprising an opening for providing fluid product into the rotor is immersed in fluid product. Thereby the inlet and the separation space are connected in a pressure mediating manner. The inlet tube may be stationary and configured to extend into an inlet chamber formed in the rotor. In one embodiment the inlet tube comprises an annular flange that extends outwardly in a radial direction such that the flange is immersed in fluid product fed into the rotor during normal operation. The rotor may comprise a set of discs configured to accelerate fluid product being fed into the inlet chamber. The set of discs causes the level of fluid product in the inlet chamber to move towards the rotational axis so that to facilitate that the inlet tube is immersed in fluid product fed into the rotor during normal operation. A centrifugal separator and a inlet device of this kind is further described in EP 0225707 B1. The configuration of the inlet device with respect to the separation space and the separating discs is disclosed in FIG. 2 of EP 0225707 B1. In another embodiment the stationary inlet tube, such as in a conventional inlet without the above mentioned flange and annular discs, is immersed in product fed into the rotor by providing a relatively high inlet flow during normal operation. Also in this embodiment the separation space is connected to the inlet in a pressure mediating manner during normal operation of the centrifugal separator since the inlet tube is immersed in fluid product.

The trigger condition may be that the ratio between the amount of flow of fluid product fed into the centrifugal separator and a positive exponent of the inlet pressure or pressure drop falls below a threshold value. The positive exponent may be 0.5 or close to 0.5. The positive exponent may be calibrated by initial measurements on a specific centrifugal separator or a specific type of centrifugal separator. Alternatively, the general relationship between inlet pressure and flow of fluid product, may be initially measured and stored for a specific separator, and the trigger condition may be that the relationship between the inlet pressure and flow of fluid product departs from the stored general relationship between inlet pressure and flow of fluid product.

The trigger condition may alternatively be that the time derivate of the ratio between the amount of flow of fluid product fed into the centrifugal separator and the positive exponent of the inlet pressure or pressure drop falls below a threshold value. This has the advantage of being independent on the relationship between inlet pressure and flow of fluid product during normal operation and at low levels of sludge.

The inlet pressure sensor may be located close to the separator in order to minimise the pressure drop from the pressure sensor to the separation space.

Further, a discharge control system for a centrifugal separator according to the pre-characterising portion of claim 1 is provided wherein the discharge control system configured to trigger the opening of the second outlet upon a trigger condition, and wherein the discharge control system comprises a sensor arranged to determine the inlet pressure and/or the inlet flow of fluid product, and the trigger condition is associated with a decrease in inlet flow in relation to inlet pressure, indicating an increasing flow resistance downstream of the inlet.

Further, a method for controlling the intermittent discharge of a centrifugal separator according to what is previously described is provided, the method comprising the steps of;

- detecting the pressure in the inlet of the centrifugal separator,
- determining the flow of fluid product fed into the centrifugal separator,
- upon detecting a trigger condition associated with a decrease in the amount of flow of fluid product in relation to the inlet pressure, triggering the opening of the second outlet to discharge the second phase of the product, wherein the trigger condition may be that the ratio between the amount of flow of fluid product fed into the centrifugal separator and the square root of the inlet pressure falls below a threshold value.

Still other objectives, features, aspects and advantages of the invention will appear from the following detailed description as well as from the drawings.

BRIEF DESCRIPTION OF THE DRAWINGS

Embodiments of the invention will now be described, by way of example, with reference to the accompanying schematic drawings, in which.

DETAILED DESCRIPTION

Figure 1:
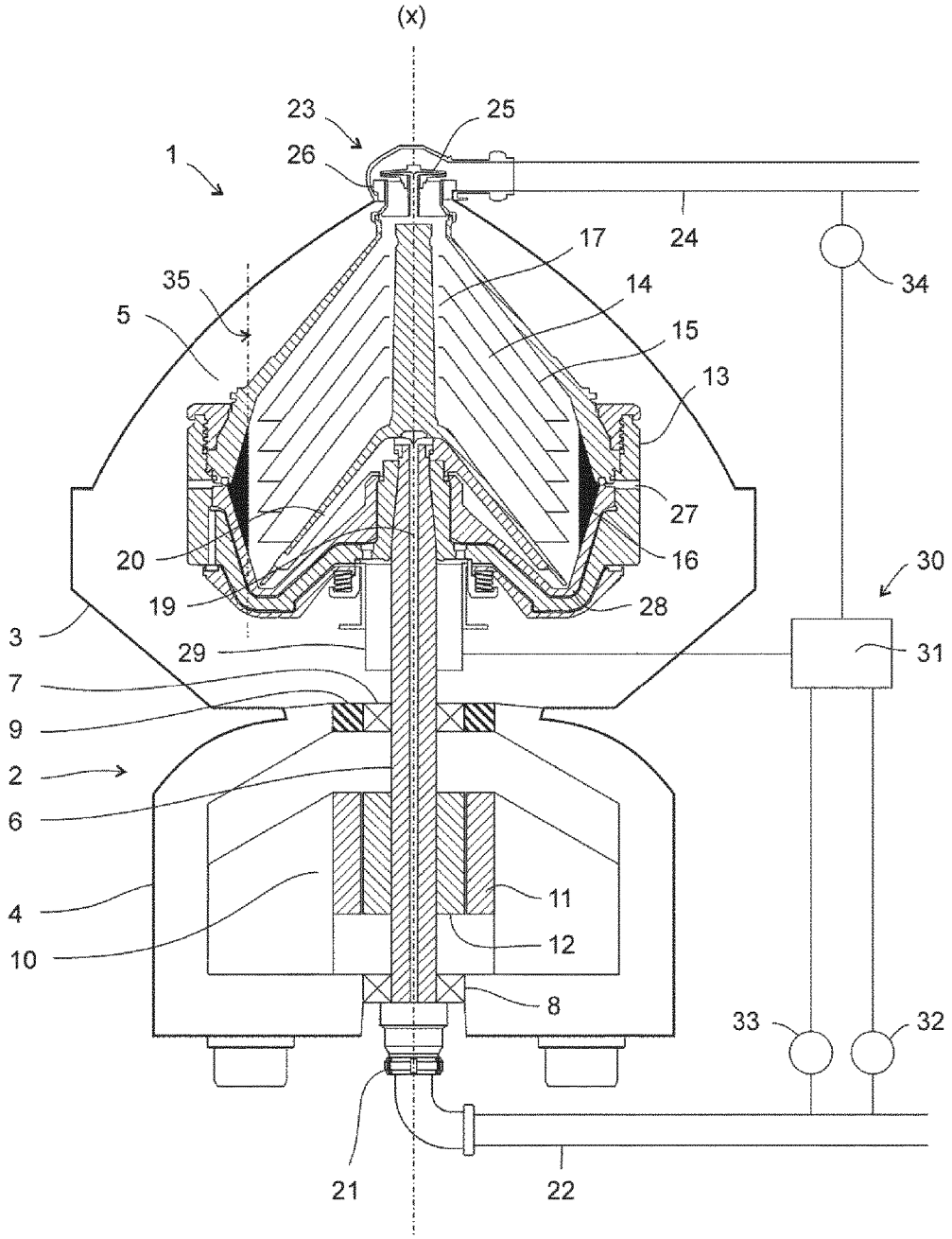
FIG. 1 shows a centrifugal separator having a hermetic inlet and a discharge control system.

With reference to FIG. 1 a centrifugal separator 1 is shown, having a frame 2 with an upper frame part 3 and a lower frame part 4. A separator rotor 5 is arranged for rotation in the frame around a rotational axis (x). The rotor comprises a spindle 6 which is supported in the lower frame part by means of an upper 7 and a lower 8 bearing. The upper bearing is elastically connected to the frame by means of a spring device 9. An electric motor 10 comprising a motor stator 11 connected to the lower frame part and a motor rotor 12 connected to the spindle is configured to drive the spindle and thus the separator rotor. The separator rotor comprises a bowl 13 forming within itself a separation space 14. In the separation space a set of frustoconical separation discs 15 is arranged along the rotational axis. The separation discs extend from a radially outer portion of the separation space, the sludge space 16, to a radially inner portion 17 of the separation space. The separator is further provided with a hermetic inlet comprising an inlet channel 19 formed in the spindle. The inlet further comprises channels 20 formed in the rotor and extending from the inlet channel to the separation space. The inlet is hermetically sealed from the surroundings of the separator by means of a seal 21 in the interface between the rotating part of the inlet channel and a stationary part 22 of the inlet channel.

The separator shown in FIG. 1 has a first outlet 23 in the form of a hermetic outlet extending from and communicating with the radially inner portion 17 of the separation space and connecting it to an outlet channel 24. The first outlet comprises a rotatable pump device 25. The first outlet is hermetically sealed from the surroundings of the separator by means of a seal 26 in the interface between the rotatable part and the stationary part of the outlet.

The separator further comprises a second outlet 27 extending from the sludge space 16 to a space outside the rotor, and comprising a plurality of ports. The opening of the second outlet is controlled by means of an operating slide 28 arranged to be axially displaceable in the rotor between a first position where the second outlet is closed and a second position where the second outlet is open. The displacement of the operating slide is performed by means of controlling the amount of operating water in chambers positioned below the operating slide, as known in the art. The addition and removal of operating water in the chambers positioned below the operating slide is controlled by an operating water control device 29.

The separator further comprises a discharge control system 30 comprising a control unit 31 connected to the operating water control device 29, and arranged to trigger the opening of the second outlet upon a trigger condition. The discharge control system further comprises an inlet pressure sensor 32 and a flow sensor 33, arranged to sense the pressure and the flow in the inlet channel. An outlet pressure sensor 34 is arranged to sense the pressure in the first outlet channel.

Since the discharge control system relies only on information that can be achieved by measurements in external parts of the separator (such as in the inlet channel and first outlet channel) retrofitting existing installations is made possible, without having to dismantle the separator.

During operation of the centrifugal separator 1 the motor 10 provides a driving momentum to the spindle 6 to bring the rotor 5 into rotation. A fluid product, being a liquid mixture of components, is made to flow into the separator through the inlet channels 22, 19 and 20 and into the separation space 14. In the separation space the fluid product is subjected to centrifugal forces, and a first phase of the product having a lower density and a second phase of the product having a higher density (the sludge phase, comprising dense solid particles) are separated from the fluid product. The separation is facilitated by the frustoconical separation discs 15. The first phase of the product is transported radially inwards between the separation discs and towards the first outlet 23, by means of the centrifugal forces. The first phase is then discharged through the first outlet 23 and 24 via the pump device 25. The second phase is transported radially outwards and collected in the sludge space 16. While the separation process continues, the amount of sludge in the sludge space increases, whereby the interface 35 between the sludge accumulated in the sludge space and the fluid product in the separation space 14 is displaced radially inwards. As the interface is displaced radially inwards and approaches the radially outer portion of the separation discs, it has been discovered that the flow resistance over the inlet and the first outlet of the separator increases. It has also been discovered that in a centrifugal separator configured such that the separation space is connected to the inlet in a pressure mediating manner during normal operation of the centrifugal separator, this tend to increase the pressure and/or decrease the flow in the inlet of the centrifugal separator depending on how the flow is maintained through the inlet, e.g. how an inlet pump is configured. In the centrifugal separator shown in FIG. 1, wherein the inlet is hermetically sealed from the surroundings of the separator, the inlet and the separation space are connected in such a pressure mediating manner . The increased flow resistance is detected by the inlet pressure sensor 32 detecting an increasing pressure and/or the flow sensor 33 detecting a decrease in the flow. The pressure detected by the inlet pressure sensor may be compensated by the pressure detected by the outlet pressure sensor 34 in order to avoid the influence of any downstream fluctuations. The outlet pressure may be compensated by the pressure contribution from the pump device 25.

The sensed pressure and flow values are communicated to the control unit 31 wherein a parameter is determined based on the ratio between the amount of flow of fluid product fed into the centrifugal separator and the square root of inlet pressure. The parameter may preferably be averaged over a running period of time, such as 10 s. When the parameter falls below a threshold value corresponding typically to 95-98% of the maximum of the averaged value during normal operation this is construed as a condition for triggering the discharge of the second phase through the second outlets. Upon fulfillment of this trigger condition, the control unit initiates discharge by the operating water control device 29. Thereby the operating slide is displaced, the second outlets are opened and the sludge phase is discharged from the sludge space by means of centrifugal forces.

Figure 2:
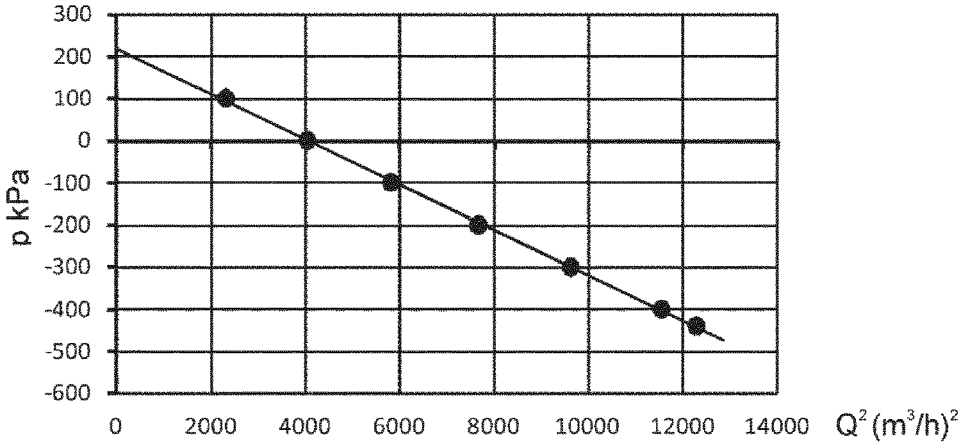
FIG. 2 shows a plot of the relationship between the inlet pressure and the square flow rate, and the corresponding linear approximation.

FIG. 2 shows an example of a plot of the relationship between the pressure boost (the negative of the pressure drop) and the square flow rate in a centrifugal separator corresponding to the one shown in FIG. 1. The separator is provided with a hermetic inlet and a hermetic outlet, and the outlet is provided with a pump device. Measurements of inlet pressure and flow rate are shown as dots, and a linear approximation corresponding to the inlet pressure being proportional to the square of the flow rate (i.e. the square root of the inlet pressure correspondingly being proportional to the flow rate) is inserted as a line. The example shows that the linear approximation of the relationship between the inlet pressure and the square flow rate is surprisingly accurate, in particular at normal flow rates of about 30 $m^3/h$ and above. It was thus discovered that this relationship could form a basis for discharge triggering.

Figure 3:
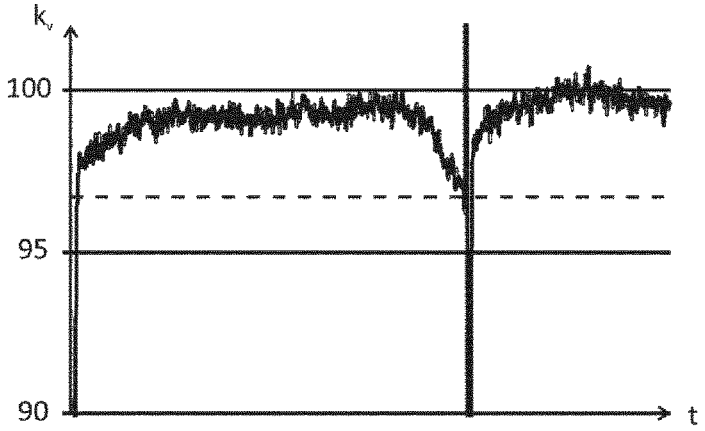
FIG. 3 shows a plot of a parameter related to the ratio between the inlet flow and the square root of the inlet pressure of a fluid product fed into a centrifugal separator.

In FIG. 3 a plot of the parameter previously described is shown for a separator corresponding to the one shown in FIG. 1, over time. This separator is provided with a pump device 25 on the first outlet giving a contribution to the pressure in the outlet channel. The parameter plotted is the ratio $k_v$, between the flow Q and the square root of the pressure drop averaged over a period of 10 s (and in the plot normalised against the maximum of the averaged value during operation). The pressure drop is in this case the difference between measured inlet pressure, $p_{in}$, and measured outlet pressure, $p_{out}$, corrected by the pressure contribution from the pump device $p_{pump}$, which may be estimated to the pressure of the liquid in the separator bowl in rigid body rotation ($p_{pump} \approx 0.5\ \rho\ \omega^2\ (r_{outer}^2 - r_{inner}^2)$, wherein ρ is the liquid density, ω is the angular rotation and $r_{outer}$ and $r_{inner}$ is the outer and inner radius of the liquid body);

$$k_v = \frac{Q}{\sqrt{p_{in} - (p_{out} - p_{pump})}}$$

Upon reaching a threshold of the parameter at about 97% of the normalised maximum, discharge is trigged (vertical line). Following discharge the procedure is iterated.

Figure 4:
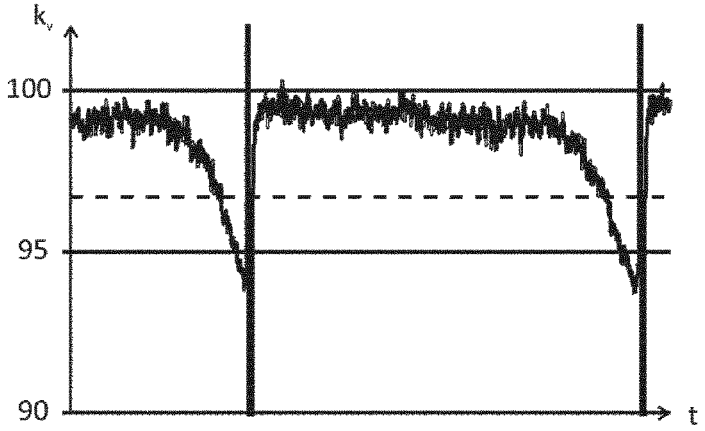
FIG. 4 shows a plot of a parameter related to the ratio between the inlet flow and the square root of the inlet pressure of a fluid product fed into another centrifugal separator.

For a separator corresponding to the one shown in FIG. 1, but without any pump device on the first outlet, a similar plot of the parameter (now without any pressure contribution from a pump device) is shown in FIG. 4. Again, discharge could have been initiated at about 97% of the normalised maximum, but this example shows discharge at about 94% of the normalised maximum.

It was found during experiments that the described method of triggering discharge was at least as effective as a method based on the measurement of turbidity on the first phase of the product in the first outlet.

Figure 5:
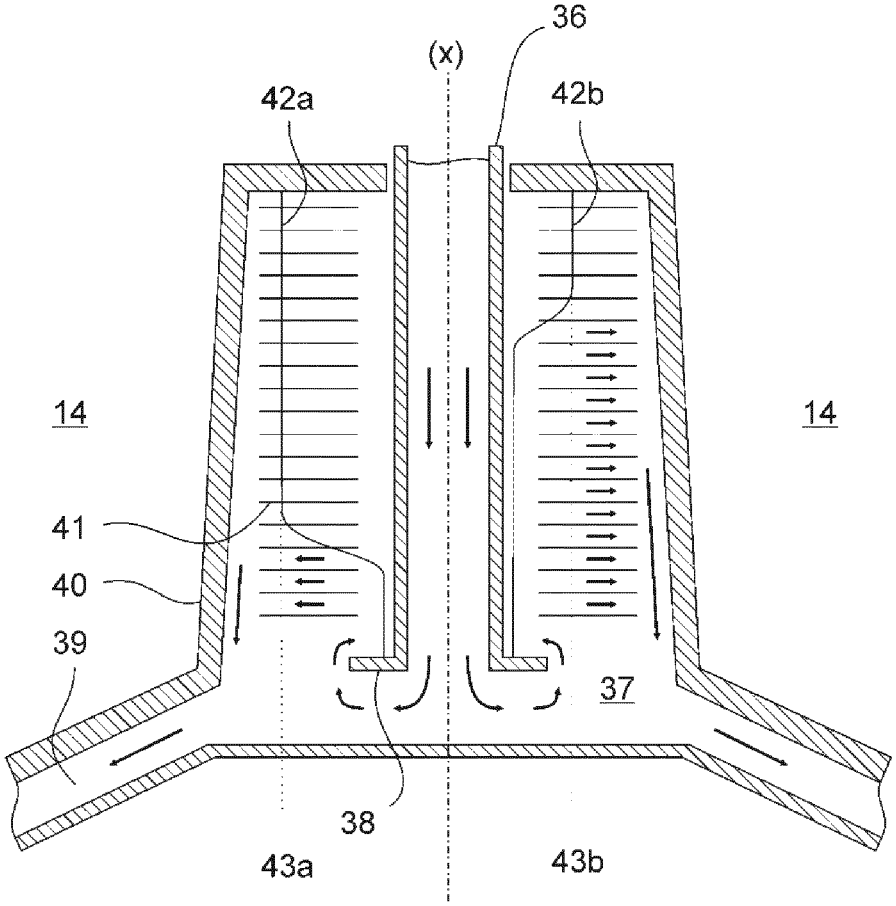
FIG. 5 shows an inlet of a centrifugal separator provided with acceleration discs.

FIG. 5 shows the central portion of the rotor of another centrifugal separator provided with an inlet in the form of a stationary pipe 36, extending into an inlet chamber 37 (receiving chamber) formed in a central portion of the rotor of the centrifugal separator. The inlet pipe is provided with an annular flange 38 extending in a radial direction. From the inlet chamber, channels 39 (corresponding to channels 20 in the separator shown in FIG. 1) extend to the separation space 14. The inlet chamber 37 and the separation space 14 are separated by a wall 40 formed in the rotor. The inlet chamber is provided with a set of annular acceleration discs 41 arranged along the rotational axis (x). A centrifugal separator and a inlet device of the kind shown in FIG. 5 is further described in EP 0225707 B1. The configuration of the inlet device and the annular discs with respect to other parts of the separator, such as the separation space and to the separating discs is disclosed in FIG. 2 of EP 0225707 B1. It should be noted that an inlet of this type is not necessarily a hermetic inlet, since the inlet chamber 37 is not necessarily sealed from the surrounding of the separator.

During operation of a centrifugal separator having an inlet device as shown in FIG. 5 a fluid product, being a liquid mixture of components, is made to flow into the separator through the inlet pipe 36 and into the inlet chamber 37. Due to viscous forces in the liquid mixture flowing between the non-rotating inlet pipe and the rotating parts of the rotor the liquid mixture flows around the edge of the flange 38 and into the set of annular discs 41. The effect of this is that the flange is immersed in fluid product fed into the rotor during normal operation. Depending upon the magnitude of the incoming flow, the liquid mixture will pass through a larger or smaller number of the passages between the discs 41, as shown on the left hand side of FIG. 5 (low flow) and right hand side (high flow). In the remaining passages between the discs 41 a free liquid surface 42*a* (low flow), 42*b* (high flow), is formed. The mixture then flows towards the channels 39 and into the separation space 14.

Similar to what has been described in relation to FIG. 1, sludge will accumulate in the outer portion of the separation space during operation of the separator. This will increase the flow resistance from the channels 39, over the separation discs and to the first outlet, as previously discussed. The level of the free liquid surface 42, 43, will then move inwards and the pressure in the inlet pipe 36 will increase. Hence, also the separator according to FIG. 5 is configured such that the inlet and the separation space are connected in a pressure mediating manner during normal operation of the centrifugal separator. Thus a centrifugal separator configured according to FIG. 5 allows the triggering of discharge by monitoring the pressure in the inlet and the flow of the fluid product into the separator. Alternatively, by increasing the radial extent of the flange 38 so that it is immersed in fluid product fed into the rotor during normal operation even absent the set of discs 41, the resulting fluid level then being indicated by dotted lines 43*a* (low flow) and 43*b*, a similar effect is achieved.

In yet another embodiment the inlet flow during normal operating conditions is sufficient to immerse the inlet tube in the inlet chamber even if there is no flange on the inlet tube, such as in a conventional separator inlet.

The invention claimed is:

1. A centrifugal separator comprising:

a frame;

a rotor arranged for rotation in the frame around a rotational axis and forming within itself a separation space;

an inlet configured to feed a fluid product to be separated into the separation space, wherein the separation space is connected to the inlet;

a first outlet extending from the radially inner portion of the separation space for discharge of a first phase of the product;

a second outlet extending from the radially outer portion of the separation space for intermittent discharge of a second phase of the product;

an inlet pressure sensor arranged to determine an inlet pressure of the fluid product provided to the separation space;

a closure for the second outlet having a closed position and an open position; and a discharge control system configured to trigger the opening of the closure based on the inlet pressure measured by the inlet pressure sensor, wherein the first phase of the product has a lower density than the second phase of the product.

2. The centrifugal separator according to claim 1, wherein the discharge control system comprises an outlet pressure sensor arranged to determine the outlet pressure in the first outlet, and wherein the inlet pressure is compared to the outlet pressure to calculate a pressure drop between the inlet and the first outlet to trigger the opening of the closure.

3. The centrifugal separator according to claim 1, further comprising a pump connected to the first outlet, wherein the inlet pressure is compared to the pressure contribution of the pump to the outlet pressure to trigger the opening of the closure.

4. The centrifugal separator according to claim 1, wherein the inlet is a hermetic inlet.

5. The centrifugal separator according claim 1, wherein the inlet comprises an inlet tube configured to be immersed in fluid product fed into the rotor during normal operation of the centrifugal separator.

6. The centrifugal separator according to claim 5, wherein the inlet tube comprises a flange that extends outwardly in a radial direction such that the flange is immersed in fluid product fed into the rotor during normal operation.

7. The centrifugal separator according to claim 5, wherein the rotor comprises a set of discs configured to accelerate fluid product being fed into the separation space.

8. The centrifugal separator according to claim 1, wherein the trigger condition is a ratio between the amount of flow of fluid product fed into the centrifugal separator and the inlet pressure.

9. A centrifugal separator, the centrifugal separator comprising:

a frame;

a rotor arranged for rotation in the frame around a rotational axis and forming within itself a separation space, wherein a set of separation plates is arranged, extending from a radially outer portion of the separation space to a radially inner portion of the separation space;

an inlet configured to feed a fluid product to be separated into the separation space, wherein the centrifugal separator is configured such that the separation space is connected to the inlet;

a first outlet extending from the radially inner portion of the separation space for discharge of a first phase of the product;

a second outlet extending from the radially outer portion of the separation space for intermittent discharge of a second phase of the product;

a closure for the second outlet having a closed position and an open position; and a sensor detecting a pressure at the inlet, a discharge control system for opening the closure for the second outlet based on the detected pressure at the inlet of fluid product provided to the separation space.

10. A method for controlling the intermittent discharge of a centrifugal separator, said method comprising the steps of:

supplying a liquid through an inlet;

separating the liquid into a first phase and a second phase;

removing the first phase through a first outlet;

removing the second phase through a second outlet, the second outlet having a closure, the closure having a closed positon and an open position;

detecting a pressure in the inlet of the centrifugal separator;

determining the flow of fluid product fed into the inlet of the centrifugal separator;

detecting a trigger condition, the trigger condition being the detected pressure in the inlet of fluid product provided to the separation space or the flow of the liquid to the inlet;

opening of the second outlet to discharge the second phase of the product based on the trigger condition.

11. The method according to claim 10, wherein the trigger condition is a ratio between the amount of flow of fluid product fed into the centrifugal separator and the square root of the inlet pressure falling below a threshold value.

12. The method according to claim 10, wherein the trigger condition is a pressure at the inlet increasing more than a predetermined amount.

13. The method according to claim 10, wherein the trigger condition is a flow rate at the inlet decreasing more than a predetermined amount.

14. The centrifugal separator according to claim 1, wherein the closure is a slide movable in an axial direction of the rotor.

15. The centrifugal separator according to claim 9, wherein the closure is a slide movable in an axial direction of the rotor.

16. The centrifugal separator according to claim 9, wherein the trigger condition is the pressure at the inlet increasing more than a predetermined amount.

17. The centrifugal separator according to claim 9, wherein the trigger condition is a flow rate at the inlet decreasing more than a predetermined amount.

18. The centrifugal separator according to claim 9, wherein the trigger condition is a ratio between the amount of flow of fluid product fed into the centrifugal separator and the inlet pressure falling below a threshold value.

* * * * *